United States Patent [19]

Zobel et al.

[11] Patent Number: 4,893,391

[45] Date of Patent: Jan. 16, 1990

[54] METHOD AND APPARATUS FOR PRODUCING ROUND-ROLLED PARTS FOR HEAT EXCHANGERS

[75] Inventors: Werner Zobel, Böblingen; Wolfgang Ostertag, Walddorfhäslach, both of Fed. Rep. of Germany

[73] Assignee: Kühlerfabrik Längerer & Reich GMBH & Co. KG, Fed. Rep. of Germany

[21] Appl. No.: 207,374

[22] Filed: Jun. 15, 1988

[30] Foreign Application Priority Data

Jun. 27, 1987 [DE] Fed. Rep. of Germany ..... 3721257

[51] Int. Cl.[4] ..... B23P 15/26

[52] U.S. Cl. ..... 29/157.3 R; 29/157.3 C; 72/151; 72/296; 72/301; 72/369; 264/291; 264/292

[58] Field of Search ..... 29/157.3 R, 157.3 C; 72/369, 153, 296, 297, 151, 301; 264/291, 292

[56] References Cited

U.S. PATENT DOCUMENTS

| | | | |
|---|---|---|---|
| 2,412,731 | 12/1946 | Hoffman | 72/151 |
| 3,148,721 | 9/1964 | Seavers | 72/151 |
| 3,443,296 | 5/1969 | Clausing | 72/369 |
| 4,443,921 | 4/1984 | Allemandou | 29/157.3 |
| 4,584,765 | 4/1986 | Gray | 29/157.3 C |
| 4,727,737 | 3/1988 | Bryant | 72/153 |

FOREIGN PATENT DOCUMENTS 3131736 4/1982 Fed. Rep. of Germany .

*Primary Examiner*—P. W. Echols
*Assistant Examiner*—K. Jordan
*Attorney, Agent, or Firm*—Michael J. Striker

[57] ABSTRACT

The method of making a round-rolled part for a heat exchanger comprises connecting the tubes and the irradiating elements to each other to form a rectilinear network, clamping both ends of the rectilinear network and stretching and bending the clamped network so that it assumes an arcuate shape. The premise adopted is that of a network of flat tubes consisting of rectangular tubes and irradiating elements between them, the tube network being bent round around a narrow side of the tubes. The network has one end rigidly gripped on the bending tool. The tubular network is wound onto it by rotating the latter. There is applied to the other end of the network a retaining force which counteracts the winding-on force and which maintains the tube network under tensile stress. The apparatus comprises a rotatable round bending tool and a clamping means which tangentially clamps the end of the network. Spaced from the round bending tool there is a mating holder for firmly gripping the other end of the network.

27 Claims, 3 Drawing Sheets

METHOD AND APPARATUS FOR PRODUCING ROUND-ROLLED PARTS FOR HEAT EXCHANGERS

BACKGROUND OF THE INVENTION

Our invention relates to a method of producing round-rolled parts for heat exchangers, particularly heat exchangers having spaced-apart tubes and irradiating elements disposed between the tubes.

A method of this type is already known in which the tube network is bent round between individual bending rollers or in a drop forging die with the help of a mold part, the round bending force thus being applied to both narrow sides of the tubes. When this method is used, there is the danger that particularly with the relatively thin tubes in the network, bending may result in the formation of creases, bulges, cracks and other distortions.

SUMMARY OF THE INVENTION

It is an object of our invention to provide a method which permits the round-rolling or bending of rectilinear tube networks in a simple and inexpensive manner so that the formation of cracks, creases, bulges, kinks or other distortions is reliably avoided.

In keeping with these objects and with others which will become apparent hereinafter the method of producing round-rolled parts for heat exchangers including spaced-apart tubes and, in between them, irradiating elements, comprises firstly connecting the tubes and the irradiating elements to one another in a rectilinear network of tubes, clamping both ends of the rectilinear network of tubes and stretching and bending the rectilinear network of tubes and elements by relative motion of the ends of the network of tubes.

The application of tension may be effected prior to or on commencement of bending process. Therefore, either prior to or immediately upon commencement of the bending process, the tube network is subjected to flexure and tension thus avoiding creases, cracks, bulges, kinks or the like. Also the risk of any distortion of shape can be excluded. At the same time, the method is easily implemented because if the round bending is initiated by bending the tube network around the fixed round bending tool or by causing rotation of the round bending tool onto which the tube network should be more or less substantially wound, then both ends or for example the other end remote from the round bending tool will be moved in the direction of the round bending tool. Therefore, it is relatively simple and inexpensive to apply to these appropriate areas adjacent the end or ends a corresponding retaining force which arrests or counteracts this movement so that the tube network can be subjected to a tensile stress superimposed on the bending process. In the present invention it is possible also to round-roll those networks of tubes in which initially no end plates have been mounted. In this case, the relevant clamping force for gripping the tube network is exerted on the tube network in the region of the tube ends without the need for any additional end plates which may be already mounted thereon. Thus it is possible also to fit the end plates later on, after the round part has been produced, and also to go over to other fixing methods, e.g. adhesion instead of soldering and so on. In the case where a tube network is already fitted with end plates and possibly with side parts connected thereto, the clamping force for bending may be exerted on the tube network in the region of the relevant end plates so that in every instance there is provision for large-area support on the relevant end plate. In this respect, clamping takes place in the region of the end plates so that upon bending of the tube network, no part of the surface of the relevant end plate can bulge or otherwise sag. Instead, the end plates always retain their original shape thus insuring that the points of connection of the tubes to the end plates are not jeopardized by any misshaping of the end plates, so that a tight connection of the tube plate to the manifold which will subsequently be mounted on it can be guaranteed. Depending on the thickness and construction of the end plate, it may be advantageous to exert the clamping force on both sides of the appropriate end plates thus rigidly clamping both sides of the end plates to prevent any sagging or bulging of the end plates.

The appropriate side parts assume a relatively marked supporting function during round bending. The side parts can have regular smooth rectangular components so that they are very stable. In this manner it is possible to avoid damage to the irradiating elements, particularly the plates, during round bending or rolling. Further according to our invention the apparatus for producing round-rolled parts for heat exchangers comprising a network of spaced-apart tubes and, in between the spaced-apart tubes, a plurality of irradiating elements, and two side parts and at least one end plate for the tubes comprises a locally fixed round bending tool operated by rotation on which the network of the tubes is bent to form the round-rolled part, a clamping means which maintains one end of the network of the tubes substantially tangentially while clamping the network fixed on the round bending tool, a mating holder spaced from the round bending tool provided with a gripping means for the other end of the network of the tubes and an entraining means which engages between the end plate and the side parts at respective ends of the network of the tubes for both the gripping means and the clamping means.

The apparatus is of simple construction, is easy to use, its function is easy to monitor and it has the advantage that while taking into account today's demands in terms of modern production engineering, it permits a reproducible production of the desired round parts with a constant quality and refinement.

BRIEF DESCRIPTION OF THE DRAWING

The objects, features and advantages of our invention will be better understood by referring to the following detailed description, reference being made to the accompanying drawings in which.

DETAILED DESCRIPTION OF THE INVENTION

Figure 1:
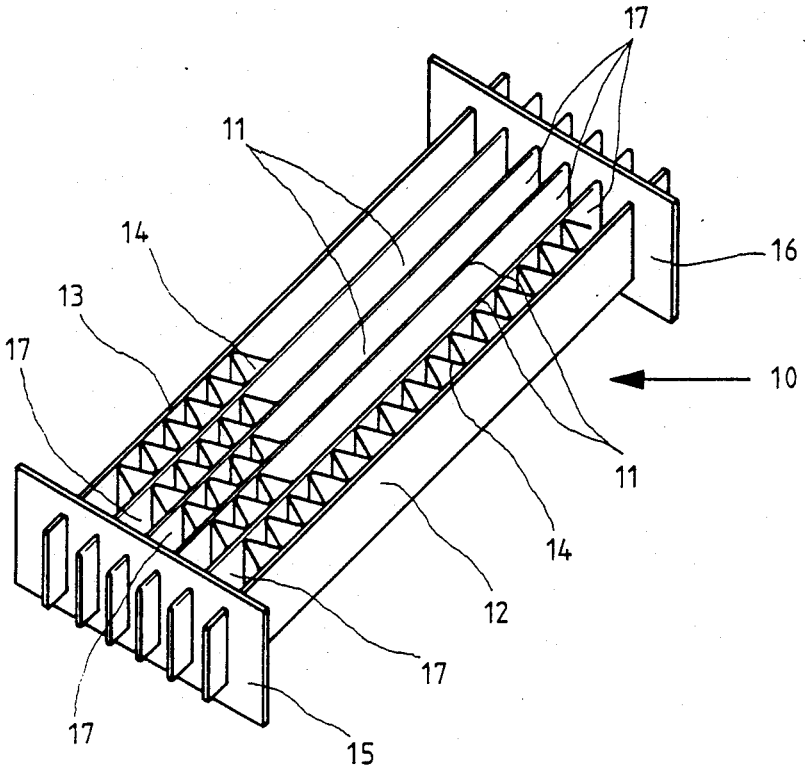
FIG. 1 is a diagrammatic perspective view of a rectilinear tube network for heat exchangers prior to round bending.

FIG. 1 shows a rectilinear network 10 of tubes which is in the form of a soldered unit intended as a part of a heat exchanger, not shown in greater detail. The tube network 10 comprises individual tubes 11 which extend at intervals from one another and which have an at least substantially rectangular cross-section and which, in the embodiment illustrated, are constructed as flat tubes with rounded-off narrow sides. In the region of the two outer faces there are side parts 12,13 which may have a rectangular cross-sectional form. In the intermediate space between the tubes 11 as well as between the side parts 12,13 and the tubes 11 there are irradiating elements 14 which in this case consist, for instance in known manner, of zig-zag plates. The irradiating elements 14 bear on the broad surfaces of the tubes 11 or side parts 12,13 to which they are soldered. At each of the two ends of the tube network 10 is an end plate 15 or 16 traversed respectively by the ends of the tubes 11 and the side parts 12,13, the ends of the tubes 11 and of the side parts 12,13, projecting beyond the end plates 15,16. The end plates 15,16 are rigidly connected, e.g. by soldering or even by adhesion or by some other manner, to the tubes 11 and to the side parts 12,13. The irradiating elements 14 in the form of zig-zag strips end in each case before the end plate 15 with a space between them and the associated end plate 16 so that there remain in this area free spaces 17. These free spaces are formed between adjacent tubes 11, the end of one irradiating element 14 and the side of the end plate 15 or 16 facing it, and in the same way also in the region of the outer sides, where instead of the tubes 11 it is the side parts 12,13 which form the boundary. Tube networks 10 which are so constructed in this rectilinear format as shown in FIG. 1 are already known as networks of flat tubes.

Figure 2:
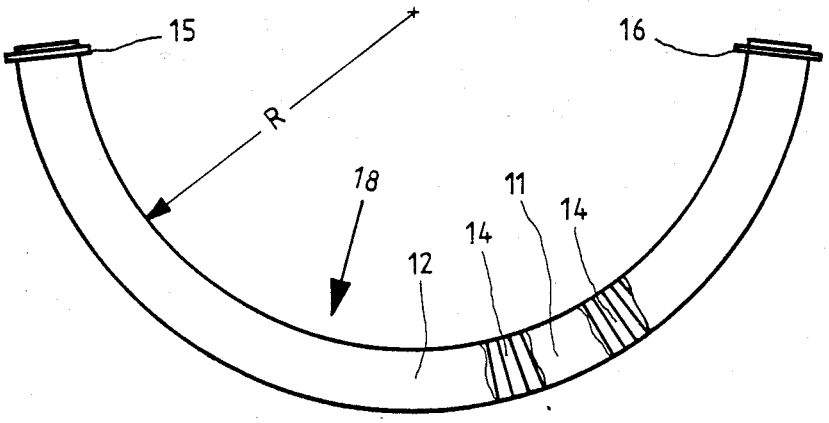
FIG. 2 is a diagrammatic side view of the tube network in FIG. 1 in the round-bent state.

The object of the invention is to provide a method or and an apparatus for round-rolling or round bending such a tube network 10, starting from the soldered and rectilinear unit, producing the round part 18 shown in FIG. 2. This method, by means of which profiled elongated bodies, e.g. networks of flat tubes, can be round-rolled on or around an edge of the flat tubes without any deviation or distortion of shape is known as a stretching or bending process. Details of the method and of the apparatus are explained hereinafter with reference to FIGS. 3 to 9.

Shown in FIGS. 3 to 9 is an apparatus 20 which is suitable for producing round-rolled parts 18 for heat exchangers, e.g. for annular radiators. The apparatus 20 comprises a round bending tool 21 which in this case consists of a drum 22 having a smooth shell 23 with a cylindrical outer periphery centered and supported by spokes 24 or the like. The round bending tool 21 is mounted to rotate on an axle 25 by means of bearings 26. The bearings 26 are seated in two lateral supports 27 which extend upwardly from a base plate 28. Engaging the round bending tool 21 is a diagrammatically indicated drive 29 for rotating the round bending tool 21, the drive possibly being a mechanical, an electrical or in particular a hydraulic drive. For bending, the round bending tool 21 is driven by the drive 29 in a clockwise direction according to the arrow 30.

In the case of another embodiment, not shown, the round bending tool 21 consists of a segment of a cylinder instead of the drum 22.

Figure 3:
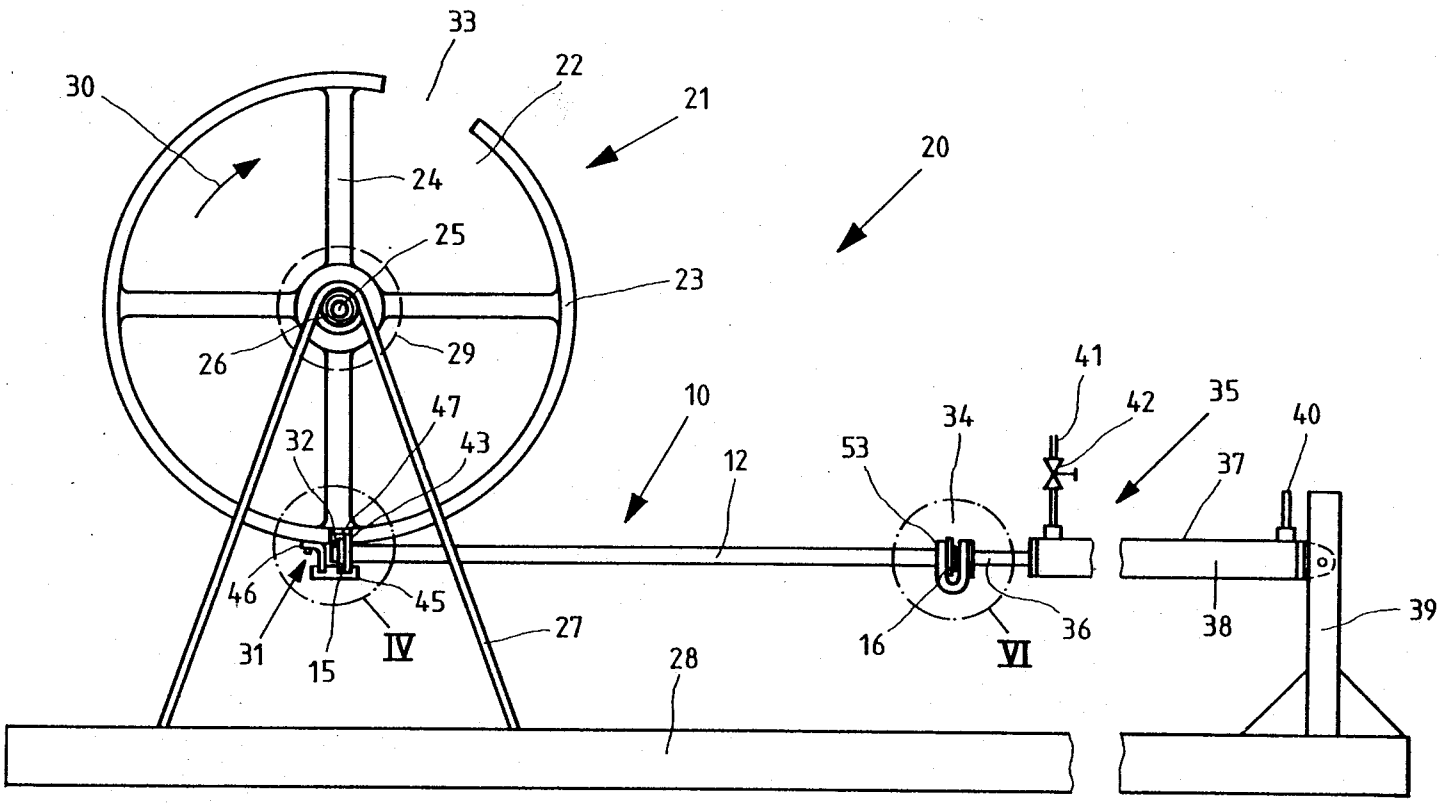
FIG. 3 is a diagrammatic side view of an apparatus for round bending.
Figure 6:
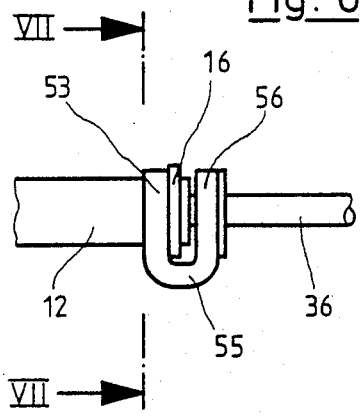
FIG. 6 is a detailed cutaway side view of the portion of the tube network shown in FIG. 3 in the dot-dashed circle VI of FIG. 3.
Figure 7:
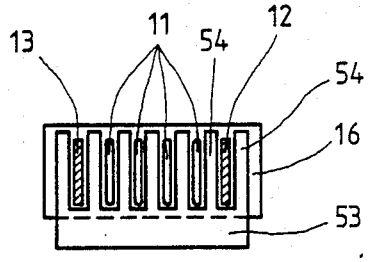
FIG. 7 is a side view in the direction of the arrow VII—VII in FIG. 6.
Figure 4:
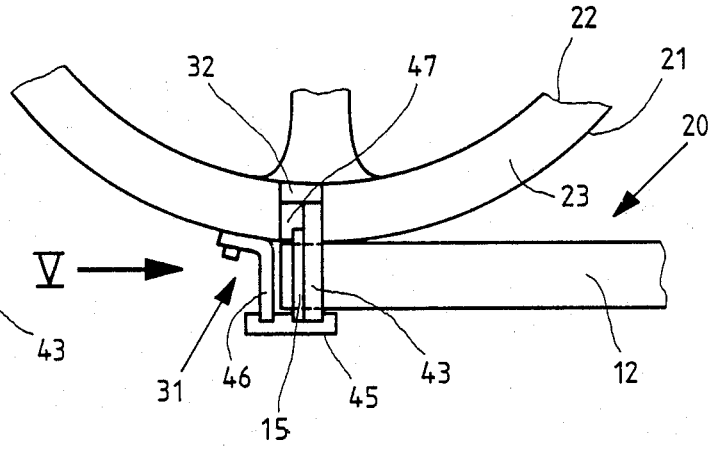
FIG. 4 is a detailed cutaway side view of the portion of the tube network shown in FIG. 3 in the dot-dashed circle IV in FIG. 3.

Because of the pivot mounting of the bending tool, the round bending tool 21 is fixed in its location in relation to the base plate 28 and is adapted to be rotated about the axle 25. The outer peripheral face of the drum shell 23 is smooth. The outer radius of the round bending tool 21 corresponds at least substantially to the bending radius R to which the rectilinear tube network 10 is to be bent to produce the round part 18. The axial width of the drum 22 is at least as great as the width of the tube network 10. The round bending tool 21 has in the outer peripheral zone a clamping means generally designated 31, by means of which the tube network 10 can be gripped in the region of the left hand end (in relation to FIG. 1) and clamped in a substantially tangential orientation at the round bending tool 21 as FIGS. 3 and 4 show. The clamping means 31 is housed in a recess 32 in the drum shell 23. The recess 32 is relatively small in a peripheral direction and is adapted to the individual parts of the clamping means 31. At a peripheral angular distance from the recess 32, the drum shell 23 is provided with another recess 33 in which, at the end of the bending operation, a gripping means 34 is at least partially housed, being disposed at a distance from the round bending tool 21 and likewise on the base plate 28, serving to grip the other end of the tube network 10 which is on the right in FIG. 1. The gripping means 34 is part of a mating holder generally designated 35. For bending the rectilinear tube network 10, this latter is firmly gripped on the round bending tool 21 by the end which is shown on the left in FIGS. 1 and 2, the round bending tool 21 being then rotated in the direction of the arrow 30 about the axle 25 by engaging the drive 29, so that the tube network is wound around at least a part of the drum shell 23. With the onset of the winding process and during the winding process, there is exerted on the other end of the rectilinear tube network 10 which is held by the gripping means 34 on the mating holder 35 a retaining force which counteracts the winding force and which imposes and maintains a tensile stress on the tube network 10. Therefore, it is only at the onset of the bending process and then during the bending process that the tube network 10 is additionally biased by a tractive force.

The mating holder 35 comprises a longitudinally displaceable supporting member 36 which, while the tube network 10 is being wound on the round bending tool 21, can be pulled with a force in order to generate a retaining force, the clamping means 34 being held at the end of the carrier part 36. In the case of the embodiment illustrated, the mating holder 35 is constructed as a working cylinder 37 operated by a pressurized medium, in fact a double-acting hydraulic cylinder. The cylinder housing 38 is pivotally connected to the base plate 28 via a brace 39 and the piston rod is displaceable relative thereto and forms the carrier part 36. Any mechanically, hydraulically or pneumatically operating device can be provided to serve as a mating holder 35. The working cylinder 37 is provided with two connections 40,41 by which, via the connection 41, the medium displaced from the inside of the working cylinder 37 is discharged when the carrier part 36 in the form of the piston rod is, in relation to FIG. 3, withdrawn leftwardly from the cylinder housing 38. On the side on which the pressurized medium is displaced, in other words in the region of the connection 41, the working cylinder 37 is provided with an adjustable throttle 42 for pressurized medium, consisting for instance of an adjustable pressure control valve by means of which the displacement current can be throttled and in this way a retaining force can be generated, its magnitude being adjustable.

Figure 5:
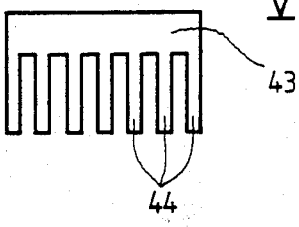
FIG. 5 is a side view in the direction of the arrow V of a part of the clamping means of the apparatus.
Figure 9:
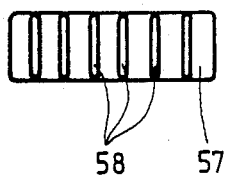
FIG. 9 is an end view of the finger strip with supporting fingers.

The clamping means 31 is shown in detail in FIGS. 4 and 5. It comprises a substantially comb-like entraining means 43 of which the tines 44 engage between the tubes 11 with side parts 12 and 13 in the (in relation to FIG. 1) left hand end portion of the tube network 10, the tubes 11 and side parts 12,13 being accommodated in the gaps between the tines 44. Therefore, the tines 44 engage into the free spaces 17 in the end portion of the tube network 10 which is shown on the left in FIG. 1, a large-area bracing and supporting of the end plate 15 on the entraining means 43 being achieved. A part of the entraining means 43 engages into the recess 32 in the round bending tool 21 and is entrained thereby as the round bending tool 21 rotates.

It will be understood that the entraining means 43 may be a rigid component of the round bending tool 21. The clamping means 31 furthermore comprises a clamp 45 which, when the entraining means 43 is in use, engages in form locking manner over this and over the outside of the end plate 15, being for example separably held on the round bending tool 21. The clamp 45 is for example supported by means of an angle bracket 46 which is separably mounted on the round bending tool 21. Inside the recess 32 there is a substantially angular filler piece 47 which fits in form locking fashion into the recess 32. In its shape and dimensions, the filler piece 47 is so chosen that when the entraining means 43 is engaging the recess 32, along with the end plate 15, the filler piece 47 keys both components rigidly and form lockingly in the recess so that there is no longer any clearance.

The gripping means 34 of the mating holder 35 has a likewise substantially comb-shaped entraining means 53 the tines 54 of which, in the same way as the entraining means 43, engage between the tubes 11 with side parts 12,13 in the free spaces 17, the gaps between the tines 54 accommodating the tubes 11 and the side parts 12,13. Therefore, the entraining means 53 likewise has a large area bearing on the inside of the end plate 16 so that there is in the same way a large area of support. The entraining means 53 comprises one leg portion of a U-shaped bracket 55, of which the other leg portion is supported on the carrier part 36 and which form lockingly accommodates in the interior of the end plate including any ends of the tubes 11 which may be projecting beyond it, as well as any side parts 12,13 of the tube network 10.

The device 20 can furthermore, for example for each end of the tube network 10, comprise a finger strip 57 carrying spaced-apart from one another supporting fingers, the distance between them corresponding to the distance between the tubes 11. Also the cross section of the supporting fingers 58 is shaped and dimensioned according to the hollow profile of the tubes 11.

Figure 8:
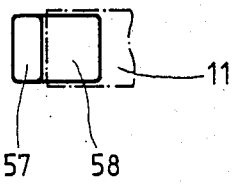
FIG. 8 is a diagrammatic side view of a finger strip with bracing fingers engaging the ends of the tubes.

The supporting fingers 58 can be inserted into the tubes 11 from the tube end and can support the tube walls and prevent the flat tube walls being pressed in during bending of the tube network 10. The number of supporting fingers 58 corresponds to the number of tubes 11 in the tube network 10. FIG. 8 shows in dash-dotted lines one end of a tube 11 into which a supporting finger 58 engages.

In another unshown embodiment the supporting fingers 58 are provided directly on one of the parts of the clamping means 31 or gripping means 34. According to the construction of these means, the finger strips 57 may also be combined with a part of the clamping means 31 or gripping means 34.

In the case of the clamping means 31 shown in the drawing, the entraining means 43 thereof bears over a large area against the inside of the end plate 15 which is on the left in FIG. 1. In the same way, the entraining device 53 of the clamping means bears over a large area on the inside surface of the end plate 16 which is on the right in FIG. 1. According to the thickness of the material and the construction of the particular end plate 15,16 involved, it may be advantageous for the clamping means 31 and the gripping means 34 to be so constructed that the relevant end plate 15 or 16 is rigidly clamped not only on the inside but also on the outside, in other words on both sides. Consequently, when the tube network is subjected to bending, no part of the surface of the end plate 15,16 will either collapse or bulge outwards. It is all the more guaranteed that when the tube network 10 is bent, the end plate 15 and 16 will in each case retain its original form, the joints of the tubes 11 in the end plates 15,16 being in no way endangered by any deformation, a tight seal between the end plate and the manifold which will subsequently be fitted in this area being guaranteed.

Instead of the tube network 10 as described and taking for instance the form of a soldered unit prior to bending and provided with end plates 15,16 in the case of another embodiment, not shown, the bending process can also be carried out without the end plates 15,16 being mounted and secured, in which case the clamping means 31 and the gripping means 34 are constructed so that the ends of the tubes 11 and the side parts 12,13 are rigidly clamped by them, in fact so that during bending they are subject to virtually no deformation and so that, furthermore, the tractive force initiated through the retaining force at the start of the bending operation can also be transmitted. The end plates can, when bending is completed to produce the round part 18, be fitted onto the ends of the tubes 11 and the side parts 12,13 to which they can then be connected. If necessary, any misshaped end pieces of the tubes 11 and possibly also of the side parts 12,13 can still be cut off before the end plates are fitted.

In the manner described it is possible for the rectilinear tube network 10 to be bent into a round part 18 in that a round bending force is exerted on the upper narrow sides of the tubes 11. In detail, the rectilinear tube network 10 is rigidly clamped at the end which is on the left in FIG. 1, by means of the clamping means 31 and in the manner described, being applied against the circular round bending tool 21 so that the tube network 10 bears on it substantially tangentially as is shown particularly in FIG. 4. If desired, it is possible to insert into the tubes 11 at least at both ends, supporting members which brace the tube walls and which are for example supporting fingers 58 mounted on the finger strip 57. In the case of another unshown embodiment supporting ribs extending from wall to wall can be used as such supporting members. The supporting members, e.g. supporting fingers 58, can be fitted into the tubes 11 prior to bending and then withdrawn from them after bending.

Before the start of the winding operation, the rectilinear tube network 10 is at the other end, shown on the right in FIG. 1, and which is opposite the other end which is clamped rigidly on the round bending tool 21, firmly clamped by the gripping means 34 of the mating holder 35, which is capable of applying a retaining force, as FIG. 3 shows. By adjusting the pressurized medium throttle 42 it is possible furthermore to adjust the retaining force and to keep this constant for instance throughout the winding process. By reason of the mode of operation of the clamping means 31, which firmly grips on the round bending tool 21 at that end of the tube network 10 which is on the left in FIG. 1, the clamping force is exerted in the region of the left hand end of the tube network 10.

By virtue of the gripping means 34, the appropriate clamping force is likewise exerted in the region of the tube ends at the other end of the tube network 10, which is on the right in the drawing. At both ends, the force engages the end plates 15,16 via the entraining devices 43,53. The bending process is initiated by switching on the drive 25 and rotating the round bending tool 21 in the direction of the arrow 30 so that the tube network 10 is wound onto at least a part of the outer periphery of the round bending tool 21. With the initiation of the winding process and during this process, that end of the tube network 10 which is on the right in FIG. 3 is in the region of the mating holder 35 subjected to a retaining force which counteracts the winding force and which imposes and then maintains a tensile stress on the tube network 10. Since the round bending tool 21 has a fixed location throughout the winding process and is moved clockwise in FIG. 3 during the winding on of the tube network 10, a retaining force in the region of the mating holder 35 is sufficient to apply a tensile stress to the tube network 10 during the bending process. Therefore, immediately upon commencement of the bending process, the tube network 10 is subjected to a bending and also a tractive stress so avoiding creases, cracks, bulges, kinks or the like deformations of the tubes 11, the side parts 12,13 and also of the end plates 15,16 which are rigidly clamped by the clamping means 31 or the gripping means 34. When the round bending tool 21 is rotated, the tube network 10 is wound on it, the pivot angle corresponding to the desired arc required in the round part 18. At the end of the winding movement, the gripping means 34 with the end plate 16 is in the region of the recess 33 in the drum shell 23 and is housed therein. The winding process is then completed. Afterwards, the bent round part 18 is removed from the clamping means 31 and the gripping means 34. The round part 18 (FIG. 2) can then be completed to produce the heat exchanger e.g. a radiator in that for instance a manifold, not shown, is mounted on and is connected to each end plate 15,16.

It will be appreciated that annular heat exchangers e.g. annular radiators, can be bent over a much greater arc than is shown or can even be composed of at least two such round parts 18 which are then placed opposite each other to be connected by common manifolds. Also, a plurality of round parts can be positioned adjacent one another in the axial direction of an annular radiator and may be placed concentrically of one another. Thus, heat exchangers of annular form can be produced relatively easily and at a favorable cost.

While the invention has been illustrated and described as embodied in a method and an apparatus for producing round-rolled parts for heat exchangers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

We claim:

1. A method of making a round-rolled part for a heat exchanger comprising a network of spaced-apart tubes and, in between said spaced-apart tubes, a plurality of irradiating elements, said method comprising:

a. connecting said tubes and said irradiating elements to each other to form a rectilinear one of said networks of said spaced-apart tubes, said network having two ends;

b. clamping both of said ends of said rectilinear network to put said rectilinear network under tension; and c. stretching and bending said clamped rectilinear network of said tubes and said irradiating elements so that said network assumes an arcuate shape.

2. A method according to claim 1 in which said stretching and bending includes applying a winding force bending said network of said tubes into said arcuate shape and subjecting and maintaining said network of said tubes under tension.

3. A method according to claim 2 further comprising holding one of said ends fixed, bending said network of said tubes on a round bending tool and applying a retaining force opposite said winding force on said network of said tubes to the other one of said ends of said network to generate said tension.

4. A method according to claim 3 further comprising rotating said round bending tool to provide said winding force.

5. A method according to claim 3 further comprising adjusting said retaining force.

6. A method according to claim 3 further comprising holding said retaining force constant during said bending.

7. A method according to claim 3 wherein said network of said tubes is wound onto said round bending tool by rotation of said round bending tool without any local displacement of said round bending tool.

8. A method according to claim 7 in which, prior to commencement of said bending, said other end of said network of said tubes which is opposite to said end held fixed is rigidly clamped in a mating holder to generate said retaining force.

9. A method according to claim 1 further comprising supporting each of said tubes at each tube end thereof during said bending and stretching.

10. A method according to claim 1 further comprising inserting a plurality of bracing members in said tubes to provide support for a plurality of tube walls of said tubes during said bending and stretching.

11. A method according to claim 1 further comprising providing an end plate on said network of said tubes at both of said ends prior to said bending and stretching and attaching side parts to said network of said tubes.

12. An apparatus for producing a round-rolled part for a heat exchanger comprising a network of spaced-apart tubes and, in between said spaced-apart tubes, a plurality of irradiating elements, and two side parts and at least one end plate for said tubes comprising:

a. a locally fixed round bending tool operated by rotation on which said network of said tubes is bent to form said round-rolled part;

b. a clamping means which maintains one end of said network of said tubes substantially tangentially while clamping said network fixed on said round bending tool;

c. a mating holder spaced from said round bending tool provided with a gripping means for the other end of said network of said tubes; and d. an entraining means which engages between said end plate and said side parts at respective ends of said network of said tubes for both said gripping means and said clamping means.

13. An apparatus according to claim 12 in which said mating holder comprises a longitudinally-displacable carrier part on which said gripping means is supported and which is adapted to be retained with a force in order to generate a retaining force while said network of said tubes is being wound onto said round bending tool.

14. An apparatus according to claim 12 in which said mating holder comprises a working cylinder having a cylinder housing and a piston rod operated by a pressurized medium.

15. An apparatus according to claim 14 in which said working cylinder comprises a double-acting cylinder.

16. An apparatus according to claim 14 in which said working cylinder comprises a hydraulic cylinder.

17. An apparatus according to claim 14 in which a pressurized medium throttle is connected to said working cylinder so that said retaining force can be adjusted.

18. An apparatus according to claim 12 in which said round bending tool comprises a drum having a cylindrical outer periphery.

19. An apparatus according to claim 12 in which said round bending tool has one recess in said round bending tool which accommodates said clamping means and has another recess spaced arcuately from said one recess which accommodates said gripping means on said carrier part.

20. An apparatus according to claim 19 in which said clamping means has a filler piece which fits and engages said one recess in said round bending tool and whose shape and dimensions are chosen so that, when portions of said clamping means including said entraining means engage in said recess, said filler piece keys said entraining means rigidly in said recess.

21. An apparatus according to claim 12 in which said entraining means is substantially comb-shaped having tines engaging between said tubes and said side parts and accommodates said tubes and said side parts in gaps between said tines.

22. An apparatus according to claim 12 in which said entraining means engages said recess in said round bending tool by which said clamping means is entrained when said round bending tool is rotated.

23. An apparatus according to claim 12 in which said clamping means has a clip which fits over and engages said entraining means and said end plate and is held on said round bending tool.

24. An apparatus according to claim 12 in which said entraining means of said gripping means comprises one arm of a U-shaped member, the other arm of said entraining means being supported on a carrier part and said entraining means form-lockingly accommodating said side parts and said tubes of said network which protrude beyond said at least one end plate and which are contained inside of said U-shaped member.

25. An apparatus according to claim 12 in which a plurality of supporting fingers are adapted to be pushed into said tubes to support said tubes.

26. An apparatus according to claim 25 in which said supporting fingers are shaped and dimensioned to fit in said tubes.

27. An apparatus according to claim 25 in which said spaced-apart supporting fingers are carried on a finger strip.

* * * * *